US005381618A

United States Patent [19]

Singleton

[11] Patent Number: 5,381,618

[45] Date of Patent: Jan. 17, 1995

[54] SECURITY FRAME FOR VEHICLE LICENSE PLATES

[76] Inventor: Richard L. Singleton, 542 Pompano Dr., Hitchcock, Tex. 77563

[21] Appl. No.: 70,756

[22] Filed: Jun. 3, 1993

[51] Int. Cl.[6] ..... G09F 7/00

[52] U.S. Cl. ..... 40/202; 40/209; 248/551

[58] Field of Search ..... 40/201, 202, 209; 248/551

[56] References Cited

U.S. PATENT DOCUMENTS

| | | | |
|---|---|---|---|
| 1,536,414 | 5/1925 | Watts | 40/209 |
| 1,821,053 | 9/1931 | Deitz . | |
| 2,603,013 | 7/1952 | Sherwood . | |
| 2,710,475 | 6/1955 | Salzmann . | |
| 3,134,565 | 5/1964 | Trifiletti . | |
| 3,432,954 | 3/1969 | Ford . | |
| 3,611,605 | 10/1971 | Baker . | |
| 3,685,188 | 8/1972 | Syverson . | |
| 4,182,062 | 1/1980 | Krokos et al. . | |
| 4,270,287 | 6/1981 | Gimbel | 40/209 X |
| 4,891,895 | 1/1990 | DeLaquil . | |
| 4,903,422 | 2/1990 | Varga . | |
| 5,012,602 | 5/1991 | Storey . | |
| 5,027,537 | 7/1991 | Freeman et al. . | |

FOREIGN PATENT DOCUMENTS 2067328 7/1991 United Kingdom .

*Primary Examiner*—Brian K. Green

*Attorney, Agent, or Firm*—Richard C. Litman

[57] ABSTRACT

A security frame assembly for vehicle license plates provides for the complete enclosure of the plate and any dated registration decals thereon in order to prevent or increase the difficulty of the theft thereof. The device comprises a peripheral frame with a tough transparent overlay, secured to the vehicle using standard threaded fasteners. The heads of the fasteners are concealed by caps which require the use of a special tool for their removal. The transparent overlay provides for the display of the complete plate, while also protecting the plate and registration sticker from easy theft. While a determined thief could take the plate and frame, the device would require additional time which would increase the risk of being apprehended for the thief and thus make the protected plate an unattractive risk. However, the device would permit the theft of the plate and frame without damage to the vehicle, thus saving the vehicle owner any potential repair costs. Advertising or other matter may be included on the periphery of the frame.

17 Claims, 2 Drawing Sheets

SECURITY FRAME FOR VEHICLE LICENSE PLATES

FIELD OF THE INVENTION

The present invention relates generally to security devices for the prevention of theft, and more specifically to a license plate frame for vehicles which incorporates security means for the prevention of theft of the plate and/or associated dated registration tag or sticker and a specialized tool for the removal of the security means.

BACKGROUND OF THE INVENTION

In many states, positive proof of liability insurance is required before current license plates and/or motor vehicle registration may be obtained. However, vehicle owners cannot legally operate their vehicles without current registration or plates, and the operation of motor vehicles without current plates and/or registration decals is generally watched for quite closely by law enforcement personnel. As a result, the theft of motor vehicle license plates having currently valid registration stickers or decals has become increasingly popular in certain areas and states. While the operation of a motor vehicle with improper plates and/or registration is generally illegal, a vehicle with currently valid registration decals or tags on the license plate(s) is generally unlikely to be noticed by law enforcement officials unless the driver of the vehicle draws attention in some way. Thus, many individuals will take currently valid plates and/or registration decals from another motor vehicle and install those plates and/or decals on their unregistered vehicle in order to drive the vehicle without appearing to have expired registration.

Moreover, individuals who may engage in a criminal act(s) using a motor vehicle obviously will not desire to use a vehicle which can be traced back to them by means of the license plate. While motor vehicles have become increasingly difficult to steal easily, no such provision has been made for motor vehicle license plates. Accordingly, many such criminals will steal the license plate(s) from a vehicle and install those plates upon the vehicle which they use in connection with their crime. The plates are generally exceedingly easy to steal, being secured to the vehicle by only two or more standard screws or bolts. When the criminal is through with the plates, he or she will generally discard them, since other plates are equally as easy to steal. Such acts further impair justice by leading to the apprehension of innocent parties to whom the stolen plates are registered, and the waste of considerable time and effort on the part of law enforcement officials in pursuing such matters.

Accordingly, the need arises for a device providing additional security for license plates and/or registration stickers or decals secured to a motor vehicle. The device must provide a full and complete view of the plate and any associated dated sticker, tag or decal applied thereto, while at the same time securing the plate and sticker to the vehicle. The device must make it difficult to remove the plate, thus requiring additional time for the removal of the plate without the proper tools and thus discouraging a person attempting to take the plate, yet permit the plate to be taken by a determined party without undue damage to the vehicle. Finally, the security device must be easily removable by a relatively unskilled person by means of the proper specialized tool which may be provided with the security device.

DESCRIPTION OF THE PRIOR ART

U.S. Pat. No. 1,821,053 issued to Harold M. Dietz et al. on Sep. 1, 1931 discloses a License Plate Holder comprising a slotted bracket providing for the insertion of a license plate therein. A lockable retainer closes one end of the holder to secure the plate therein; the retainer is secured by means of a lock cylinder at one end thereof. The double retaining edges, pivotable end closure, and locking cylinder of the Dietz et al. device are considerably different in structure and function from the present invention.

U.S. Pat. No. 2,603,013 issued to Lester L. Sherwood on Jul. 15, 1952 discloses an Adjustable Frame for Motor Vehicle License Plates. While the screws used for securing the adjustment of the frame are concealed behind the frame, the disclosure states that the frame itself is secured to the vehicle in the conventional manner. Thus, it would be a simple matter to remove the entire frame, including the plate therein, from a vehicle.

U.S. Pat. No. 2,710,475 issued to Harry E. Salzmann on Jun. 14, 1955 discloses a License Plate Holder having a two part frame which sandwiches and secures the plate therebetween with a conventional key operated lock. The device is more closely related to the Dietz el al. device than to the present invention.

U.S. Pat. No. 3,134,565 issued to Santy Trifiletti on May 26, 1964 discloses a License Plate Mounting Device including a transverse rod which passes through two retainers secured in the attachment holes of the plate. The rod is in turn transversely secured by a collar and cotter pin. Thus, removal is easily accomplished by removing the cotter pin. Moreover, the transverse rod would obscure any legand or other information along the lower edge of the plate, which obscuration is illegal in most states.

U.S. Pat. No. 3,432,954 issued to Johnny S. Ford on Mar. 18, 1969 discloses a License Plate Holder having a two part frame and sandwiching the plate therebetween. The parts are secured with a padlock. No relation is seen to the present invention.

U.S. Pat. No. 3,611,605 issued to Jeffrey N. Baker on Oct. 12, 1971 discloses a License Plate Frame including means for firmly holding the unsecured edge of the frame against the plate to prevent vibration and rattling. The frame and plate are secured to the vehicle using conventional threaded hardware.

U.S. Pat. No. 3,685,188 issued to James Syversen on Aug. 22, 1972 discloses a License Plate Security Locking Device using a cylindrical lock secured directly through the attachment holes in the plate to the underlying vehicle. No frame is disclosed.

U.S. Pat. No. 4,182,062 issued to Tom Krokos et al. on Jan. 8, 1980 discloses a License Plate Lock Box Assembly similar to the Salzmann and Ford devices discussed above. While the device uses a special key to lock and unlock the box, the device is not a license plate frame in the sense of the present invention.

U.S. Pat. No. 4,891,895 issued to Pascal DeLaquil, Jr. on Jan. 9, 1990 discloses a License Plate Holder using a relatively complex multilayered series of frames, supports and backings secured together with numerous threaded fasteners. No resemblance to the present invention is seen.

U.S. Pat. No. 4,903,422 issued to Paul Varga on Feb. 27, 1990 discloses a License Plate Fame Assembly including means for sealing a license plate within a display enclosure. The assembly is secure to the vehicle by standard threaded fasteners extending from the back of the assembly and into the interior of the vehicle; the only access for removal or installation is from within the vehicle.

U.S. Pat. No. 5,012,602 issued to Gerald T. Storey on May 7, 1991 discloses a Locking License Plate Holder which sandwiches the license plate between a transparent sheet and a backing sheet or plate. The components are secured together by means of a cylinder type lock, in the manner of the Salzmann device.

U.S. Pat. No. 5,027,537 issued to Thomas R. Freeman on Jul. 2, 1991 discloses a Vehicle Emblem And License Plate Holder. The device provides for the installation of one or more emblems adjacent the license plate, but the plate is secured to the holder using standard fasteners providing no special theft protection.

Finally, British Patent No. 2,067,328 to Gerhard Utech et al. and published on Jul. 22, 1981 discloses an Anti-Theft Arrangement For Vehicle Identification Plate. The plate and assembly are held together by special threaded fasteners having means to prevent turning the nut to loosen the assembly.

None of the above patents, taken either singly or in combination, are seen to disclose the specific arrangement of concepts disclosed by the present invention.

SUMMARY OF THE INVENTION

By the present invention, an improved security frame for vehicle license plates is disclosed.

Accordingly, one of the objects of the present invention is to provide an improved security frame which secures the license plate(s) to a vehicle in a manner making the theft of the plate more difficult to achieve.

Another of the objects of the present invention is to provide an improved security frame which precludes the easy removal of the dated registration decal or tag from a license plate therein.

Yet another of the objects of the present invention is to provide an improved security frame which completely covers the plate and registration decal or sticker, yet provides complete visibility of the plate and registration decal.

Still another of the objects of the present invention is to provide an improved security frame which is secured to a motor vehicle by means of conventional threaded fasteners, yet includes means preventing the easy removal of such threaded fasteners to thus delay or prevent theft of the plate.

An additional object of the present invention is to provide an improved security frame which may be formed of a variety of materials and in a variety of colors.

A further object of the present invention is to provide an improved security frame which provides for the inclusion of advertising or other matter on the periphery thereof.

Another object of the present invention is to provide a specialized tool providing for the removal of the frame of the present invention.

A final object of the present invention is to provide an improved security frame for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
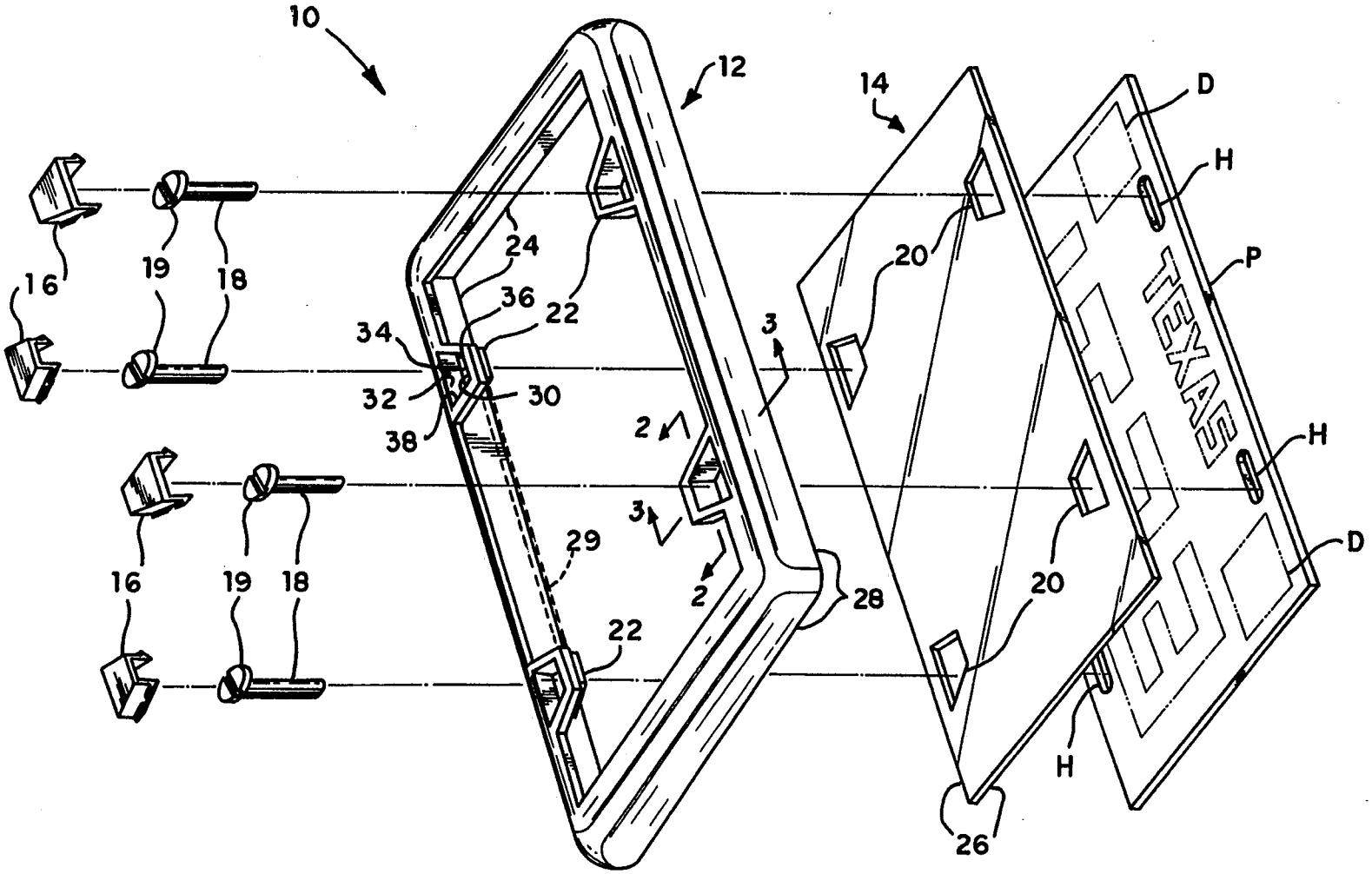
FIG. 1 is an exploded perspective view of the present invention, showing the relationship of its various components.

Referring now particularly to FIG. 1 of the drawings, the present invention will be seen to relate to a security frame assembly 10 for use with license plate P and/or other flat, plate like articles requiring security. Frame assembly 10 generally comprises a frame 12, a transparent cover 14, and a plurality of caps 16 to conceal the heads of an equal number of screws or fasteners 18. The transparent cover 14 is preferably provided with a plurality of passages 20 which mate with the mounting holes H in the plate P and further mate with a plurality of attachment lugs 22 within the perimeter of the security frame 12.

The frame 12 is generally rectangular, having four sides, and is preferably provided with an inner perimeter 24 which is slightly larger than the outer perimeter 26 of the transparent license plate cover 14. The outer perimeter 28 of frame 12 is approximately the same size and shape as the perimeter of the plate P, in order to fit within the confines of any area provided for the installation of a plate P on a vehicle or other surface. However, it will be seen that the size of the outer perimeter 28 of the frame 12 is not otherwise critical to the function of the present invention. Frame 12 may also be provided with a flange 29 extending between two spaced apart lugs 22 on one side of the frame 12, for the display of indicia for advertising or other purposes. Preferably, such a flange 29 will be formed integrally with the frame 12 and will be positioned so as to avoid the blockage or concealment of any vital portions of a license plate P which may be held therein. Frame 12 may be formed of a relatively solid, dense and durable plastic material, or alternatively formed of other materials (e.g., metals such as aluminum or steel, or other materials as desired).

Figure 2:
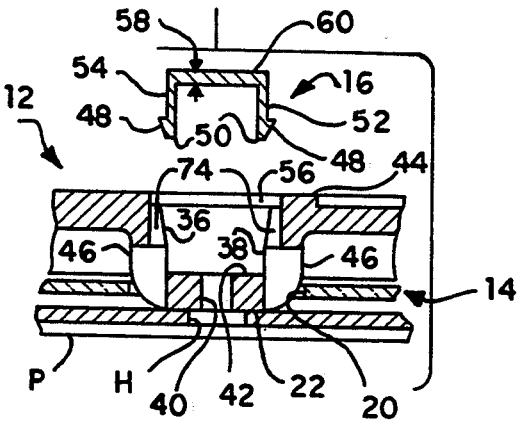
FIG. 2 is a detail view in section taken through one attachment member of the assembled frame, license plate and cover, with a protective cap shown removed.
Figure 3:
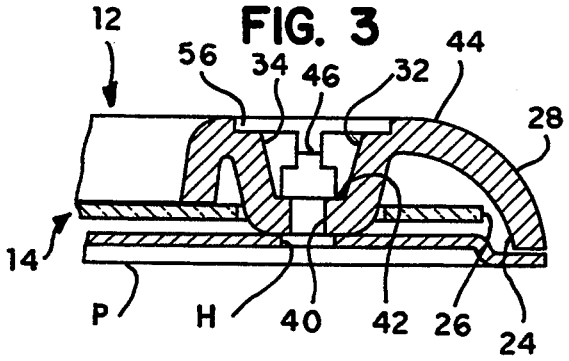
FIG. 3 is a detail view in section taken 90 degrees to the view of FIG. 2.

Frame 12 is also provided with a plurality of attachment lugs 22, as noted above and shown in detail in FIGS. 2 and 3. While four such lugs 22 are shown in FIG. 1 in keeping with the standard number of attachment holes in the typical license plate, it will be seen that more or fewer such lugs 22 may be provided without departing from the scope of the present invention. FIG. 2 provides a detail through section 2—2 of FIG. 1, while FIG. 3 shows a detail through section 3—3 of FIG. 1. (However, FIGS. 2 and 3 show the present invention with the frame 12 and cover 14 assembled on a plate P, unlike the exploded view of FIG. 1.) Each lug 22 preferably contains a generally trapezoidal or "keystone" shaped opening 30, as shown in FIG. 1, with a relatively wider outer side 32 and a relatively narrower inner side 34, joined by opposed sides 36 and 38. This shape provides a relatively unusual form for the fitting of the mating covers 16 in order to make more difficult the removal of such covers 16, and further advantages which will be described further below.

Each lug 22 includes a fastener hole or passage 40, providing for the insertion of a fastener 18 therethrough. The upper surface 42 of each fastener passage 40 will be seen to be recessed well below the outer surface 44 of the frame 12, in order to allow the head of each fastener 18 inserted therein to lie well below the outer surface 44 of the frame 12, and thus provide for the complete concealment and security of each fastener or screw 18 by means of caps or covers 16. Each lug 22 also contains an opposed lateral cutout 46 in each of the third and fourth sides 36 and 38, more clearly seen in FIG. 2 of the drawings.

Lateral cutouts 46 provide for the capture of opposed cooperating tabs 48 extending laterally from the lower edges 50 of the opposed first and second sides 52 and 54 on each of the covers or caps 16. Each of the caps 16 will be seen to cooperate closely with a corresponding opening 30 in each of the lugs 22. The flexible nature of the caps or covers 16 permits the opposed sides 52 and 54 to be distorted inwardly as the tabs 48 are pushed downward into the openings 30 and bear against the opposed side walls 36 and 38 of the lugs 22. When a cap or cover 16 is fully seated within a lug opening 30, the outwardly extending tabs 48 will flex outward to catch within the opposed cutouts 46 in the opposite sides 36 and 38 of each lug 22, thereby precluding the direct removal of a cap 16 so installed. The openings 30 of each lug 22 each further include a shallow upper receptacle 56, which receptacle or depression is the same depth as the thickness 58 of the upper surface 60 of each cover or cap 16. Thus, when a cover or cap 16 is completely installed within an opening 30 of a lug 22, the upper surface 60 of the cap 16 will be coplanar and flush with the outer surface 44 of the frame 12, precluding the ready prying off or removal of the installed cap 16 from the frame 12.

Figure 4:
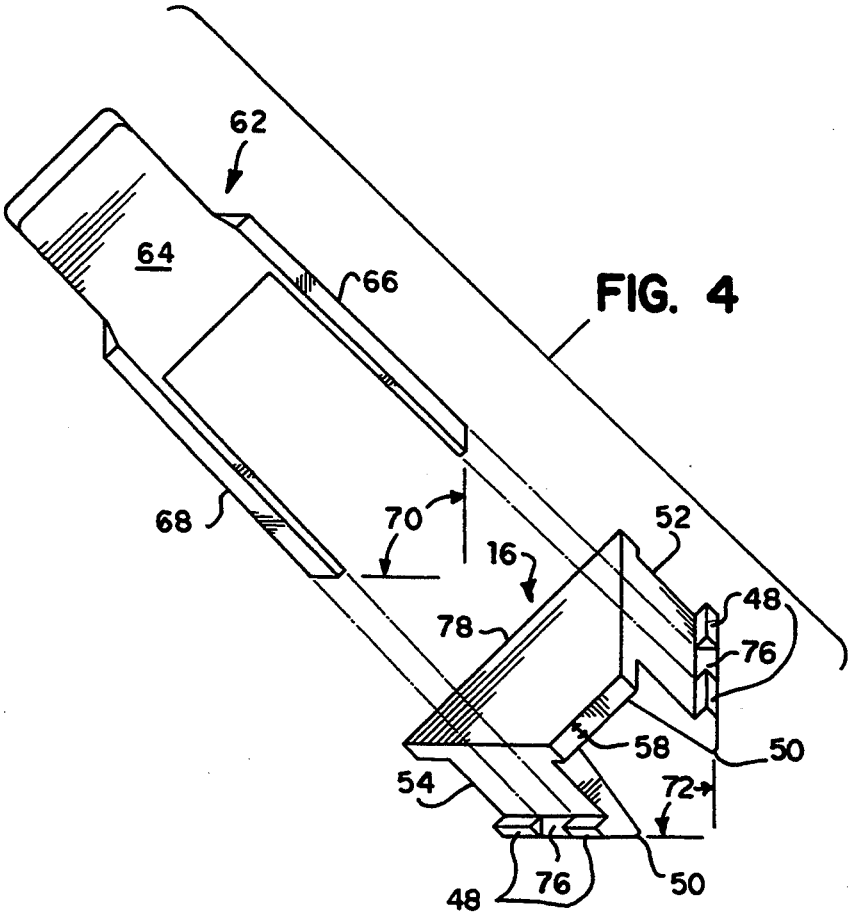
FIG. 4 is a perspective view of one of the protective caps and the removal tool therefor.

However, a cap or cover 16 may be removed easily from a lug 22 by means of the specialized cap or cover removal tool 62 shown in FIG. 4. The tool 62 includes a generally flat, planar handle portion 64 having first and second opposed tines 66 and 68 extending therefrom. Each tine 66 and 68 comprises a relatively flat bladed extension, and have an angle 70 therebetween which is equal to the angle 72 between the opposed faces or sides 52 and 54 of the covers or caps 16, and which is also equal to the angle of the opposed sides or walls within each of the lugs 22. Each of the lugs 22 includes a gap 74 disposed in each of the two opposite side walls 36 and 38 (FIG. 2), which opposed gaps 74 provide for the insertion of the tines 68 and 70 of the tool 62. Thus, when it is desired to remove an installed cover or cap 16 from a frame lug 22, the two opposed tines 66 and 68 of tool 62 may be inserted into the two opposed and cooperating gaps 74 along each of the two opposed sides 52 and 54 of the cap 16. Between each of the tabs 48 on each side 52 and 54 of each cap 16, an outwardly and downwardly formed ramp 76 is installed to provide for the ease of removal of each of the caps or covers 16. When the tines 66 and 68 of the removal tool 62 encounter the ramps 76, the rams 76 (and therefore the adjacent cover retaining tabs 48) are forced together due to the relatively rigid and inflexible tines 66 and 68. (Tool 62 is preferably formed of a relatively rigid and dense plastic material, as opposed to the relative soft and flexible plastic of the covers or caps 16. Alternatively, the tool 62 may be formed of aluminum, steel, or other materials.) In any case, the tines 66 and 68 are precluded from spreading by the opposite walls or sides 36 and 38 immediately adjacent. Thus, the tabs 48 are forced inward to clear the corresponding cutouts 46, and the cover 16 may be withdrawn from the lug opening 30 into which it was installed. The gripping of the two opposed tines 66 and 68 serves to frictionally capture the cover or cap 16 therebetween to provide for the withdrawal of the cover or cap 16. Alternatively, the tool 62 may be drawn along the sides of the cap 16 toward the wider edge 78, which action will cause the upper surface 60 of the cap 16 to flex and allow the lower edges 50 (and tab s 48) of the two opposed sides 52 and 54 to draw together in order to withdraw the tabs 48 from their corresponding cutouts. In either case, the specialized tool 62 enables one to easily remove and withdraw such caps or cover 16 from their installed position within the openings 30 of frame attachment lugs 22.

Frame assembly 10 is used by fitting the transparent cover 14 and the frame 12 over a license plate P so he holes H in the plate are aligned with the corresponding fastener passages 40 and 20 respectively of the frame 12 and cover 14. The assembly of the plate P, frame 12 and cover 14 is then fastened in place on the vehicle as desired by means of fasteners 18, with the heads 19 of the fasteners 18 seating against the upper surface 42 of the fastener holes 40. An appropriate number of caps 16 are then installed by snapping them in place so that the tabs 48 engage the cutouts 46 within the fastener lugs 22, thus concealing the fastener 18 heads and precluding easy removal without the use of the special cap removal tool 62. The cover 14 allows the plate P therebeneath to be observed readily, and yet prevents the removal of any dated registration decals D which may be secured to the plate P. When it is necessary to remove the plate P or the cover 14 (e.g., for the installation of current decals D) the cover removal tool 62 may be used as described above to remove the caps 16 easily and provide access to the fasteners or screws 18 therebeneath, thus allowing the frame 12 and cover 14 to be removed and providing access to the plate P therebeneath.

In order to provide for ease of removal of the caps 16 after the assembly of frame 12, plate cover 14 and caps 16 have been installed, the above assembly may be provided as a kit including fasteners 18 and a cap removal tool 62. Thus, the user of such a kit will always have means providing for the easy removal of the caps 16, and thus the frame 12 and cover 14, from a plate P after installation when such removal is desired.

It is to be understood that the present invention is not limited to the sole embodiment described above, but encompasses any and all embodiments within the scope of the following claims.

I claim:

1. A kit providing for the secure installation of a license plate upon a vehicle and for the ease of removal therefrom, with the license plate including a plurality of attachment holes therein, at least one dated registration decal displayed thereon and the vehicle including a corresponding number of cooperating license plate attachment points, said kit comprising:

a plurality of fasteners for securing said license plate, a license plate frame, and a transparent cover installable therein; a plurality of fastener caps installable in said license plate frame for the concealment of said fasteners therein; and a fastener cap removal tool;

each of said fasteners having a relatively small diameter shank and a relatively large diameter head;

said license plate frame being generally rectangular and having an outer surface, an outer perimeter, an inner perimeter, and four sides, with two opposite said sides each including at least two attachment lugs extending inwardly from said inner perimeter;

each of said attachment lugs having an opening therein providing for the capture of one said fastener head therein, a passage extending therethrough providing for the insertion of one said fastener therethrough, and fastener cap capture means;

said transparent cover including an outer perimeter adjacent said inner perimeter of said license plate frame and a plurality of passages therethrough, with said passages adjacent said attachment lug openings;

said fastener caps each including retaining means cooperating with said capture means of said attachment lugs; and said fastener cap removal tool comprising a handle portion having fastener cap removal means extending therefrom, whereby;

said transparent cover is installed within said inner perimeter of said license plate frame and securely retained therein, said license plate frame with said transparent cover is placed over a license plate on a vehicle, one of said fasteners is inserted within each of said attachment lugs with one said fastener shank passing through each said attachment lug passage, a corresponding one of said passages in said transparent cover, and a corresponding one of the license plate attachment holes to secure said license plate frame and said cover over the license plate and to the cooperating license plate attachment points of the vehicle with a corresponding one said fastener head captured within each said attachment lug opening, and one of said fastener caps is installed in each of said attachment lug openings to conceal a corresponding one said fastener head therein, thereby preventing the ready removal of the dated registration decal from the license plate and the license plate from the vehicle, with said fastener cap removal tool providing for ease of removal of said fastener caps by said fastener cap removal means to provide access to said fasteners for the removal thereof.

2. The license plate securing kit of claim 1 wherein:

each said attachment lug opening is defined by a first inwardly facing wall, an opposite second outwardly facing wall and third and fourth walls oppositely disposed therebetween, and each said fastener cap includes an upper surface having a shape congruent to said attachment lug opening.

3. The license plate securing kit of claim 1 wherein:

each said attachment lug opening is defined by a first inwardly facing wall and an opposite second outwardly facing wall with said first wall being shorter than said second wall, and third and fourth walls oppositely disposed therebetween to form a trapezoidally shaped opening, and each said fastener cap includes an upper surface having a shape congruent to said attachment lug opening.

4. The license plate securing kit of claim 1 wherein:

said fastener cap capture means comprises two oppositely disposed and spaced apart cutouts within each said fastener lug opening, and;

said fastener cap includes an upper surface having two oppositely disposed and spaced apart sides depending therefrom, with each of said fastener cap sides having a bottom edge with at least one tab outwardly extending therefrom, whereby;

said fastener cap sides are inserted into said fastener lug opening and said at least one tab of each of said fastener cap sides engages a corresponding one of said fastener lug cutouts to retain said fastener cap to said fastener lug.

5. The license plate securing kit of claim 1 wherein:

said license plate frame includes a flange extending between said at least two attachment lugs on one of said two opposite said sides, with said flange providing for the placement of indicia thereon.

6. The license plate securing kit of claim 1 wherein:

each said fastener cap includes an upper surface having a defined thickness, size, and shape, and;

each said fastener lug opening includes an upper receptacle having a depth equal to said defined thickness of said each said fastener cap and congruent to said size and shape of said each said fastener cap, whereby;

said each said fastener cap upper surface is coplanar with said license plate frame outer surface when said each said fastener cap is installed within said each said fastener lug opening.

7. The license plate securing kit of claim 1 wherein:

said fastener cap removal means of said fastener cap removal tool comprises two parallel and spaced apart tines, whereby;

said tines are inserted into one said fastener lug opening with each of aid tines being on opposite sides of one said fastener cap installed within said one said fastener lug opening, and said fastener cap removal tool is manipulated to release and withdraw said one said fastener cap from said one said fastener lug opening.

8. The license plate securing kit of claim 1 wherein:

at least said license plate frame and said fastener cap removal tool are formed of solid, dense plastic.

9. The license plate securing kit of claim 1 wherein:

at least said fastener caps are formed of flexible plastic.

10. An assembly kit providing for the secure installation of a license plate upon a vehicle, with the license plate including a plurality of attachment holes therein, at least one dated registration decal displayed thereon and the vehicle including a corresponding number of cooperating license plate attachment points, said assembly kit comprising:

a plurality of fasteners for securing said license plate, a license plate frame, a transparent cover installable therein; and a plurality of fastener caps installable in said license plate frame for the concealment of said fasteners therein;

each of said fasteners having a relatively small diameter shank and relatively large diameter head;

said license plate frame being generally rectangular and having an outer surface, an outer perimeter, an inner perimeter, and four sides, with two opposite said sides each including at least two attachment lugs extending inwardly from said inner perimeter;

each of said attachment lugs having an opening therein for the capture of one said fastener head therein, a passage extending therethrough for the insertion of one said fastener therethrough, and fastener cap capture means;

said transparent cover including an outer perimeter adjacent said inner perimeter of said license plate frame and a plurality of passages therethrough, with said passages adjacent said attachment lug openings; and said fastener caps each including retaining means cooperating with said capture means of said attachment lug, whereby;

said transparent cover is installed within said inner perimeter of said license plate frame and securely retained therein, said license plate frame with said transparent cover is placed over a license plate on a vehicle, one of said fasteners is inserted within each of said attachment lugs with one said fastener shank passing through each said attachment lug passage, a corresponding one of said passages in said transparent cover, and a corresponding one of the license plate attachment holes to secure said license plate frame and said cover over the license plate and to the cooperating license plate attachment points of the vehicle with a corresponding one said fastener head captured within each said attachment lug opening, and one of said fastener caps is installed in each of said attachment lug openings to conceal a corresponding one said fastener head therein, thereby preventing the ready removal of the dated registration decal from the license plate and the license plate from the vehicle.

11. The license plate securing assembly kit of claim 10 wherein:

each said attachment lug opening is defined by a first inwardly facing wall, an opposite second outwardly facing wall, and third and fourth walls oppositely disposed therebetween, and each said fastener cap includes an upper surface having a shape congruent to said attachment lug opening.

12. The license plate securing assembly kit of claim 10 wherein:

each said attachment lug opening is defined by a first inwardly facing wall and an opposite second outwardly facing wall with said first wall being shorter than said second wall, and third and fourth walls oppositely disposed therebetween to form a trapezoidally shaped opening, and each said fastener cap includes an upper surface having a shape congruent to said attachment lug opening.

13. The license plate securing assembly kit of claim 10 wherein:

said fastener cap capture means comprises two oppositely disposed and spaced apart cutouts within each said fastener lug opening, and;

said fastener cap includes an upper surface having two oppositely disposed and spaced apart sides depending therefrom, with each of said fastener cap sides having a bottom edge with at least one tab outwardly extending therefrom, whereby;

said fastener cap sides are inserted into said fastener lug opening and said at least one tab of each of said fastener cap sides engages a corresponding one of said fastener lug cutouts to retain said fastener cap to said fastener lug.

14. The license plate securing assembly kit of claim 10 wherein:

said license plate frame includes a flange extending between said at least two attachment lugs on one of said two opposite said sides, with said flange providing for the placement of indicia thereon.

15. The license plate securing assembly kit of claim 10 wherein:

each said fastener cap includes an upper surface having a defined thickness, size, and shape, and;

each said fastener lug opening includes an upper receptacle having a depth equal to said defined thickness of said each said fastener cap and congruent to said size and shape of said each said fastener cap, whereby;

said each said fastener cap upper surface is coplanar with said license plate frame outer surface when said each said fastener cap is installed within said each said fastener lug opening.

16. The license plate securing assembly kit of claim 10 wherein:

at least said license plate frame is formed of a solid, dense plastic.

17. The license plate securing assembly kit of claim 10 wherein:

at least said fastener caps are formed of flexible plastic.

* * * * *